US005344080A

United States Patent [19]

Matsui

[11] Patent Number: 5,344,080

[45] Date of Patent: Sep. 6, 1994

[54] SHOWER HEAD

[75] Inventor: Kazuhiro Matsui, Toyoake, Japan

[73] Assignee: Kitagawa Industries Co., Ltd., Japan

[21] Appl. No.: 83,895

[22] Filed: Jun. 28, 1993

[30] Foreign Application Priority Data

Mar. 25, 1993 [JP] Japan ..... 5-066960

[51] Int. Cl.[5] ..... B05Q 1/16

[52] U.S. Cl. ..... 239/449

[58] Field of Search ..... 239/436–449

[56] References Cited

U.S. PATENT DOCUMENTS

| | | | |
|---|---|---|---|
| 555,062 | 2/1896 | Murphy | 239/449 X |
| 1,330,379 | 2/1920 | Lutolf | 239/446 |
| 3,111,273 | 11/1953 | Mei | 239/447 |
| 4,187,986 | 2/1980 | Petrovic . | |
| 4,785,998 | 11/1980 | Takagi | 239/446 X |
| 4,909,443 | 3/1990 | Takagi . | |

FOREIGN PATENT DOCUMENTS

| | | | |
|---|---|---|---|
| 0276416 | 4/1987 | European Pat. Off. . | |
| 214765 | 2/1990 | Japan . | |
| 1131157 | 3/1967 | United Kingdom . | |
| 2155817 | 10/1985 | United Kingdom | 239/447 |

*Primary Examiner*—Andres Kashnikow
*Assistant Examiner*—Kevin P. Weldon
*Attorney, Agent, or Firm*—Davis, Bujold & Streck

[57] ABSTRACT

The shower head is composed of a spray head disposed at the forward end of a spray housing, a distributor disposed in the spray housing and having first and second supply openings, and a selector. By rotating the spray housing, the selector can be moved axially in the distributor. The shower head also has a first chamber disposed at the forward end of the distributor, a straight spray nozzle disposed at the forward end of the first chamber, and a needle valve. The needle valve can be slid in the first chamber and is composed of a needle and a circular plate resiliently urged to a closed position. Only when the selector pushes forward the circular plate to provide a straight spray does the straight spray nozzle communicate with the inside of the distributor. In other cases the distributor is closed by the circular plate so that the inside of the shower head is protected from dust or other foreign particles.

8 Claims, 18 Drawing Sheets

SHOWER HEAD

BACKGROUND OF THE INVENTION

This invention relates to a shower head which can spray water in various spray modes.

Conventionally, a shower head having a pistol-shaped nozzle body is known, having a handgrip with a connector for connection to a hose. A flow control valve in the body is opened and closed by operating a handle provided in the grip of the shower head.

Such shower head is proposed in Japanese Laid-open Patent Application No. 2-14765. The shower head has various kinds of nozzles for providing various spray modes. As shown in FIG. 18, a shower head 300 has inside a cylindrical selector 304 having a side opening 306 communicating to a water supply source. The selector 304 is engaged with a threaded portion 302 provided in the shower head 300. By rotating the shower head 300, the selector 304 can be slid forward or backward. According to the position of the selector 304 in the shower head 300, the kinds of nozzles for discharging water are changed. Specifically, the opening 306 is moved to the position communicating with a desired nozzle. Water is supplied from the selector 304 to the desired nozzle for discharging water in the desired spray mode.

The shower head 300 has a relatively large central nozzle 308 for discharging a jet of water. Since the central nozzle 308 is always open, dust or other foreign particles easily enters the nozzle 308 when no water is discharged from the nozzle 308 or when water is discharged from other nozzles. If the selector 304 is slid with dust entering the shower head 300, dust is caught between the inner wall of the shower head 300 and the side face of the selector 304. As a result the selector 304 may be scratched or hindered in its operation, thereby causing troublesome damage to the shower head 300.

SUMMARY OF THE INVENTION

An object of the invention is to provide a shower head which can prevent dust from entering nozzles.

This or other objects are attained by a shower head according to the invention. The shower head includes a housing defining an axis, and a shower face disposed in the housing. The shower face is provided with a first nozzle for spraying a straight jet of water and a second nozzle for spraying water in a mode different from that sprayed by the first nozzle. The shower head further includes a first chamber defined by the housing and connected to the first nozzle, and a second chamber defined by the housing, separated from the first chamber and connected to the second nozzle. The shower head also includes a water supply tube in the housing and fast with the housing, for supplying water to the first nozzle and the second nozzle, having a first opening connected to the first chamber, and a second opening connected to the second chamber. The shower head further includes a selector valve slidably mounted in the water supply tube and movable between first and second positions to connect a supply of water to the first opening or to the second opening. The shower head also includes a means for slidably moving the selector valve to and from the fist position in which water is supplied through the second opening and a second position in which water is supplied through the first opening and the spring biased valve is opened against the spring bias. When the selector is in the first position, the shower head issues water from the second nozzle, and when the selector is in the second position the shower head issues water from the first nozzle.

In the shower head according to the invention, the spring biased valve occludes the space between the first chamber and the supply water tube, except when water is discharged from the first nozzle. Thus, dust is prevented from coming from the first nozzle into the supply water tube. When water is discharged from the first nozzle, hydraulic pressure is always applied from the supply water tube toward the first nozzle. Thus, no dust enters the supply water tube.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
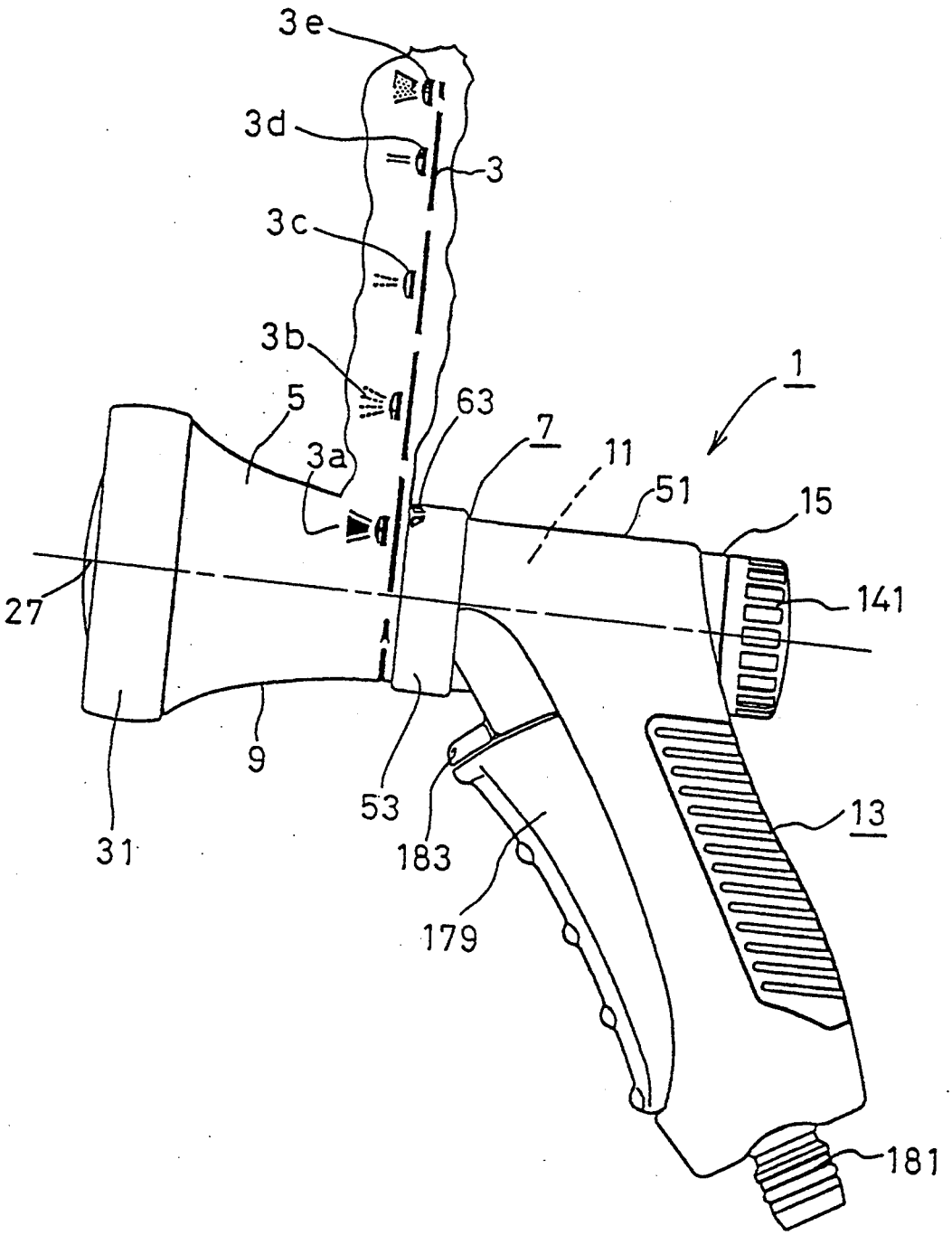
FIG. 1 is a side elevation of a shower head of one embodiment according to the invention with a portion of its exterior unrolled to show the markings therearound.

As shown in FIG. 1, a shower head 1 is shaped like a pistol and is provided with a horizontal tubular part 7 and a grip 13. The horizontal tubular part 7 is formed by a rotatable spray housing 5 and a grip housing 51 integrated with the grip 13, and includes a nozzle portion 9, a nozzle selecting portion 11 for selecting spray modes, and a water control 15. Selection marks 3 for selecting an appropriate nozzle are printed on the outer periphery of the spray housing 5 of the nozzle portion 9, and are shown in an unrolled view, as 3*a* to 3*e* in FIG. 1, for the convenience of explanation.

Figure 3:
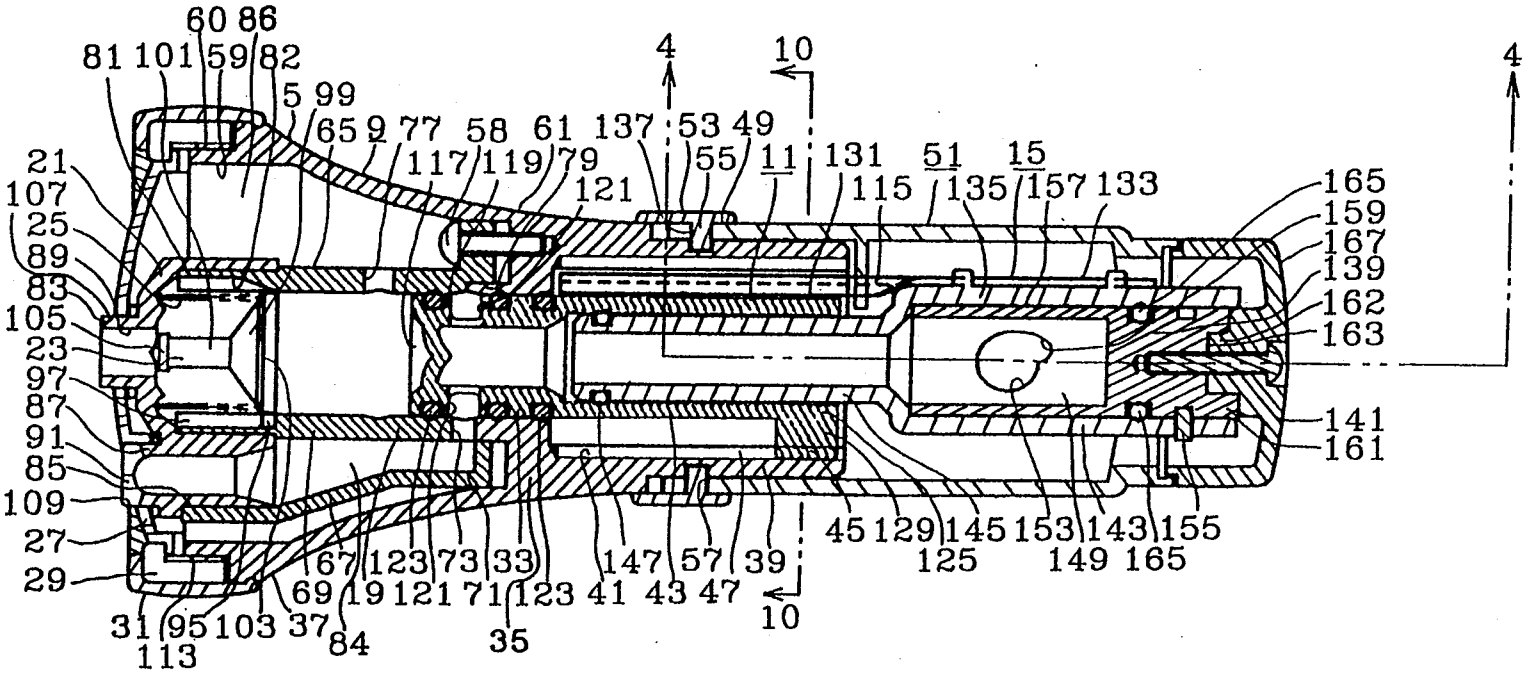
FIG. 3 is a cross-sectional view taken along line 3—3 in FIG. 2, the upper half showing the vertical section and the lower half showing the horizontal section.

As shown in FIG. 3, the nozzle portion 9 includes the spray housing 5, a distributor 19, a nozzle head 21, a needle valve 23, a coil spring 25, a spray seat 27, a ring nut 29 and a protection cover 31.

The spray housing 5 is divided by a partition 35 having a central bore 33 to form a substantially truncated conical part 37 expanding toward the forward end thereof at the left side (as viewed in the figure) and a cylindrical part 39 at the right side. The cylindrical part 39 has a threaded portion 47 as part of an inner wall 41 for engaging a threaded portion 45 provided in a selector 43 described hereinafter. The cylindrical part 39 also has a groove 57 in its outer periphery 49 for receiving a detent 55 of a T-shaped ring 53, the ring having a T-shaped cross section described hereinafter, such that the spray housing 5 is rotatably secured relative to the grip housing 51. Inside the truncated conical part 37, the distributor 19 is secured, by a screw 58, to the partition 35. At the forward end of the truncated conical part 37, the nozzle head 21 is secured to the forward end of the distributor 19. An opening 59 in the enlarged forward end of the truncated conical part 37 is occluded by the circular spray seat 27. At the rear end of an outer periphery 61 of the spray housing 5 a threaded portion 60 is formed for engaging with the ring nut 29 as described hereinafter. By aligning the desired one of the aforementioned selection marks 3 with a set mark 63 provided on the T-shaped ring 53 detailed later, a desired nozzle is selected.

In the middle of the distributor 19, a relatively large cylindrical part 65 has both ends open. As shown also in FIGS. 5 through 8, two relatively small cylindrical parts 67 are secured on the outer periphery of the large cylindrical part 65 180 degrees apart from each other about the axis of the nozzle portion 9. Spray openings 85, i.e. the left ends as viewed in FIG. 3 of the small cylindrical parts 67 are open. The relatively large and small cylindrical parts 65 and 67 are partitioned by an inner wall 69. The supply end 71, i.e. the right end as viewed in FIG. 3 of the distributor 19 is provided with a first supply opening 73 communicating with the small cylindrical parts 67, respectively. The upper face of the large cylindrical part 65 is provided with a second supply opening 77, which is not aligned with the first supply opening 73. Another second supply opening (not shown) is opposed in the underside of the large cylindrical part 65. In the inner wall of a spray end 81 of the cylindrical part 65, a groove 97 is provided for guiding a peripheral projection 95 of the needle valve 23 along the axial direction of the large cylindrical part 65 as described hereinafter. The supply end 71 of the distributor 19 is secured by the screw 58 onto the partition 35 of the spray housing 5, such that the central bore 33 in the spray housing 5 communicates with a supply opening 79 in the large cylindrical part 65.

Figure 5:
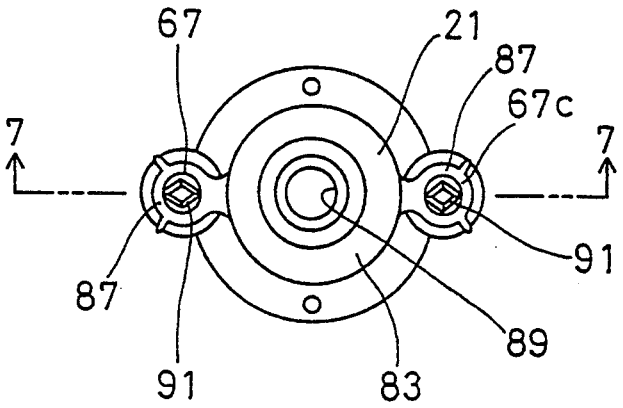
FIG. 5 is a front view of the combination of a distributor, a nozzle head, a needle and a coil spring.
Figure 6:
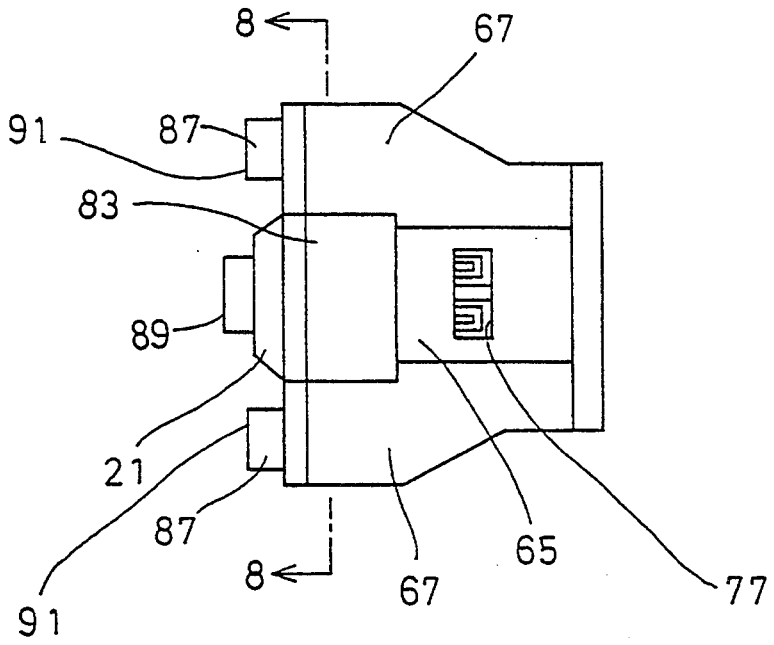
FIG. 6 is a plan view of the combination shown in FIG. 5.

As shown in FIGS. 3, 5 and 6, the nozzle head 21 has a straight spray 83 and fan-shaped sprays 87. The straight spray 83 is bonded in a watertight manner over the outer periphery of the cylindrical part 65 of the distributor 19 at the spray end 81, while the fan-shaped sprays 87 are bonded in a watertight manner inside the inner periphery of the cylindrical parts 67 at the spray end 85 thereof. Thus, the straight and fan-shaped sprays 83 and 87 are provided in the spray ends 81 and 85, respectively. The distributor 19 and the straight spray 83 form a first chamber 82, in which the needle valve 23 detailed hereinafter is arranged. The small cylindrical parts 67 and the fan-shaped sprays 87 form a second chamber 84. A third chamber 86 is enclosed by the outer periphery of the distributor 19 and the inner wall of the spray housing 5, and is connected to the second supply opening 77. As clearly shown in FIGS. 5 and 6, a circular nozzle 89 is provided in the forward end of the straight spray 83, whereas flattened rhomboid nozzles 91 having smaller open area than that of the nozzle 89 are provided in the forward end of the fan-shaped spray 87.

Figure 7:
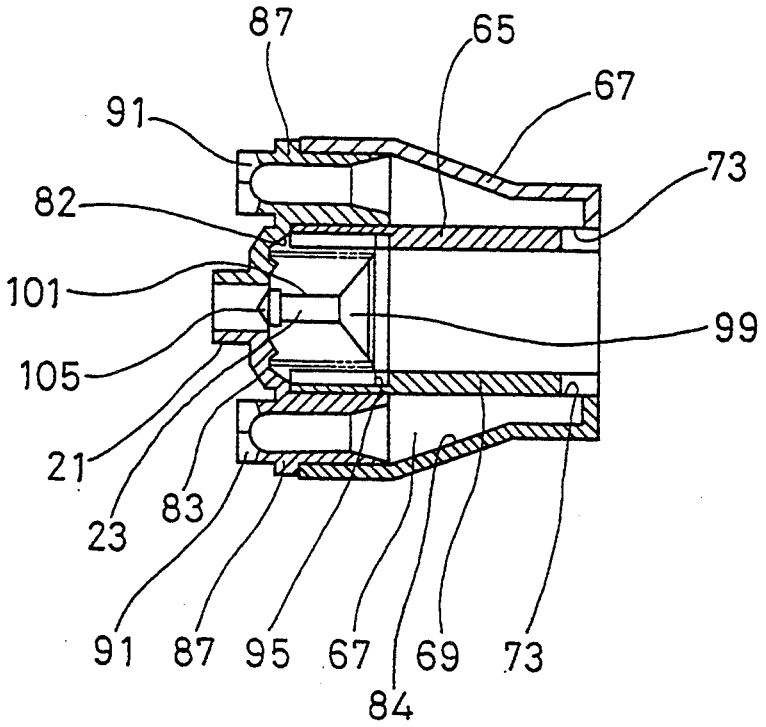
FIG. 7 is a cross-sectional view taken along the line 7—7 in FIG. 5.
Figure 8:
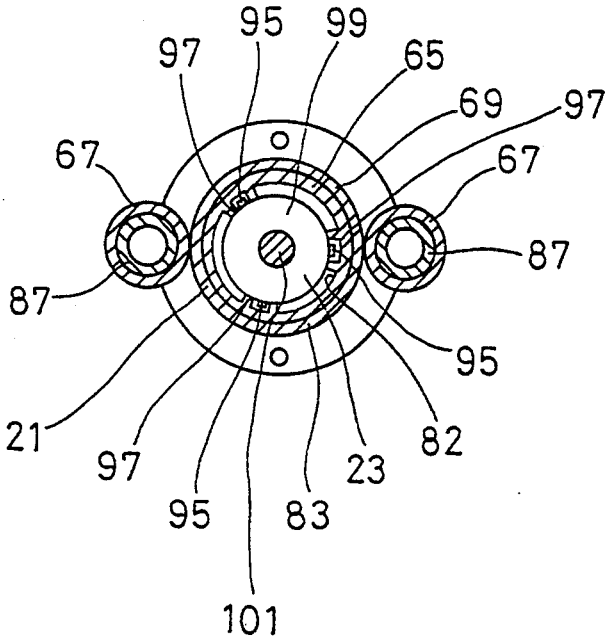
FIG. 8 is a cross-sectional view taken along the line 8—8 in FIG. 6.

As shown in FIGS. 3 and 7, the needle valve 23 is arranged in the first chamber 82, and is composed of a circular member 99 at the supply end and a needle 101 at the spray end. The circular member 99 is a truncated conical member provided with a flat bottom 103 having the outer diameter substantially the same as the inner diameter of the distributor 19. Pressure is applied by the coil spring 25 from the forward end of the first chamber 82, the circular member 99 occludes the opening of the distributor 19. Peripheral projection 95 provided on the bottom 103 slidably engages with the groove 97 in the distributor 19 to guide the needle valve 23. At the same time, further sliding of the peripheral projection 95 in the groove 97 is blocked at the rear end of the first chamber 82, such that the needle valve 23 is prevented from moving toward the rear of the distributor 19. The needle 101 is the cylindrical member having the outer diameter smaller than the inner diameter of the straight spray nozzle 89, and is formed integrally with the vertex of the circular member 99. The forward end of the needle 101 forms an umbrella-shaped point 105. The needle valve 23 is always urged from the forward end toward the rear end by the coil spring 25 disposed in the first chamber 82. When the needle valve 23 is forced toward the spray side by the selector 43 detailed later, the needle valve 23 can move forward in the first chamber 82, and the needle 101 can go out of the straight spray nozzle 89. Therefore, when the selector 43 is retreated, the needle valve 23 can move backward in the first chamber 82, and the needle 101 can return into the straight spray nozzle 89.

Figure 2:
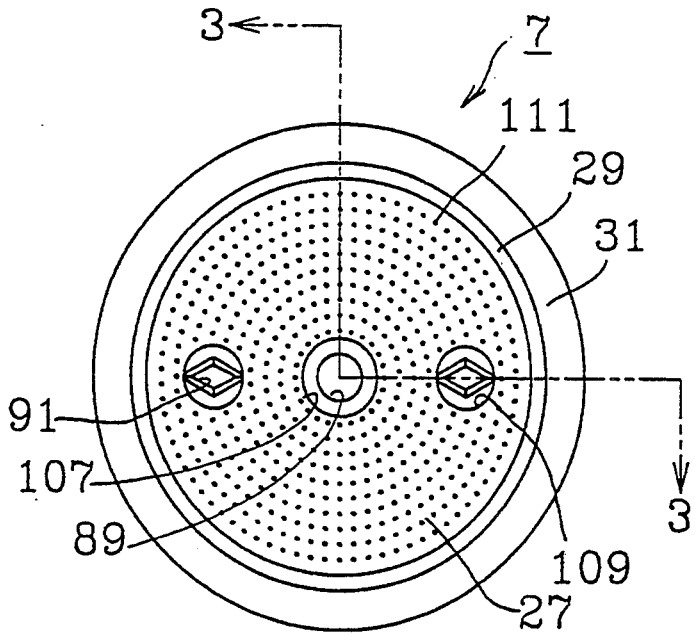
FIG. 2 is a front view of a nozzle portion of the shower head shown in FIG. 1.

As shown in FIG. 1, the middle of the circular spray seat 27 is bulged outwardly. As shown in FIG. 2, a through hole 107 for the straight spray nozzle 89 is formed in the center of the spray seat 27. Two through holes 109 are provided for the rhomboid nozzles 91, respectively. In the other surface area of the spray seat 27, perforations 111 for a fine spray are formed at appropriate intervals. As shown in FIG. 3, the spray seat 27 is secured in the opening 59 in the spray housing 5, by engaging a threaded portion 113 provided on the inner periphery of the ring nut 29 with the threaded portion 60 of the outer periphery of the forward end of the spray housing 5. The spray seat 27 is covered in a watertight manner by the rubber-like annular protection cover 31.

The nozzle selecting portion 11 includes the selector 43, selector guides 115 and the T-shaped ring 53.

Figure 10:
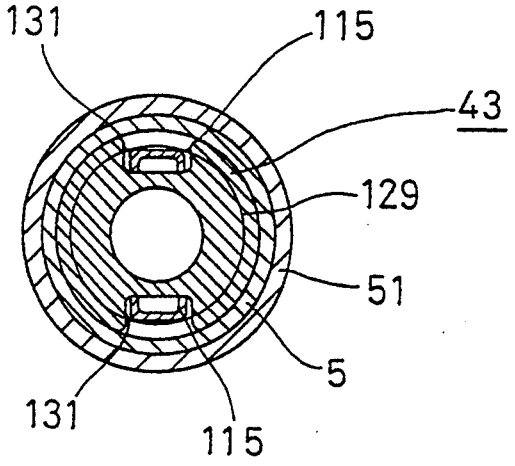
FIG. 10 is a cross-sectional view taken along line 10—10 in FIG. 3, showing the horizontal tubular portion.

As shown in FIG. 3, the selector 43 is the cylindrical member having an occluded forward end 117 and an open rear end 125. A water outlet 121 is formed in a side face 119 adjacent to the forward end 117 of the selector 43. Three 0 rings 123 are arranged adjacent to the water outlet 121 and make watertight the space between the side face 119 of the selector 43 and the large cylindrical part 65 of the distributor 19. A projection 129 provided with the threaded portion 45 is formed on the rear end 125 of the selector 43 and engages the threaded portion 47 of the spray housing 5. By rotating the spray housing 5, the selector 43 can be moved forward or backward. As shown in FIG. 10, two indentations 131 are opposed to each other in the projection 129 for slidably engaging the selector guides 115 as detailed hereinafter. The selector 43 is slidably disposed in the distributor 19.

The selector guides 115 are flat bar-shaped members with ends 133 thereof being secured immobile onto a main tube 135 housed in the grip housing 51. The selector guides 115 engage in the indentations 131 of the selector 43 so as to guide the selector 43. The threaded portion 45 of the selector 43 engages with the threaded portion 47 of the spray housing 5. Therefore, by rotating the spray housing 5, the selector 43 is guided by the selector guides 115, the selector 43 can be moved forward or backward in the distributor 19.

Figure 11:
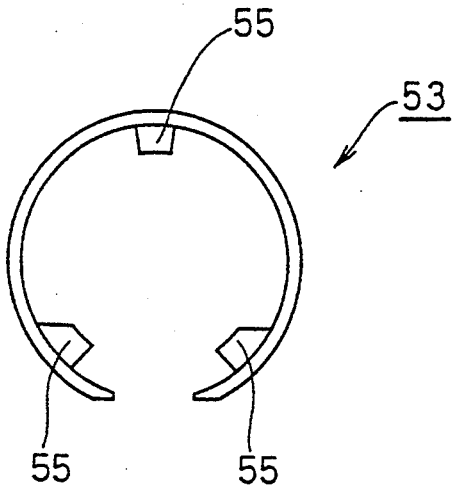
FIG. 11 is a side view showing T-shaped rings, that is, rings having a T-shaped cross section.

As shown in FIG. 11, the T-shaped ring 53 is a partially cut annular member. Three detents 55 are radially provided on the inner periphery of the T-shaped ring 53. The detents 55 pass through three through holes 137 formed in the grip housing 51 as described hereinafter, and reach the groove 57 in the spray housing 5. The spray housing 5 is thus rotatably secured relative to the grip housing 51. The T-shaped ring 53 covers the gap between the spray housing 5 and the grip housing 51. Alternatively, the surfaces of the detents 55 can be provided with projections, such that the detents 55 can be firmly attached to the grip housing 51. On the center of the outer periphery of the T-shaped ring 53, the set mark 63 is printed to be aligned with the selection marks 3 printed on the spray housing 5.

As shown in FIG. 3, the water control 15 includes the main tube 135, a tube cock 139 and a handle cock 141.

The main tube 135 is composed of a relatively large cylindrical part 143 at the supply side and a relatively small cylindrical part 145 at the spray side. The relatively large and small cylindrical parts 143 and 145 are integrally formed serially and coaxially. An O ring 147 is provided on the outer periphery of the relatively small cylindrical part 145 to render watertight the gap between the cylindrical part 145 and the selector 43 and permits the selector 43 to be slid relative to the part 145. A cylindrical water inlet 153 is provided in a wall 149 of the cylindrical part 143. Water coming from the water inlet 153 is supplied from the cylindrical part 143 through the cylindrical part 145 into the selector 43. The main tube 135 is secured immobile in the grip housing 51 as described hereinafter.

Figure 4:
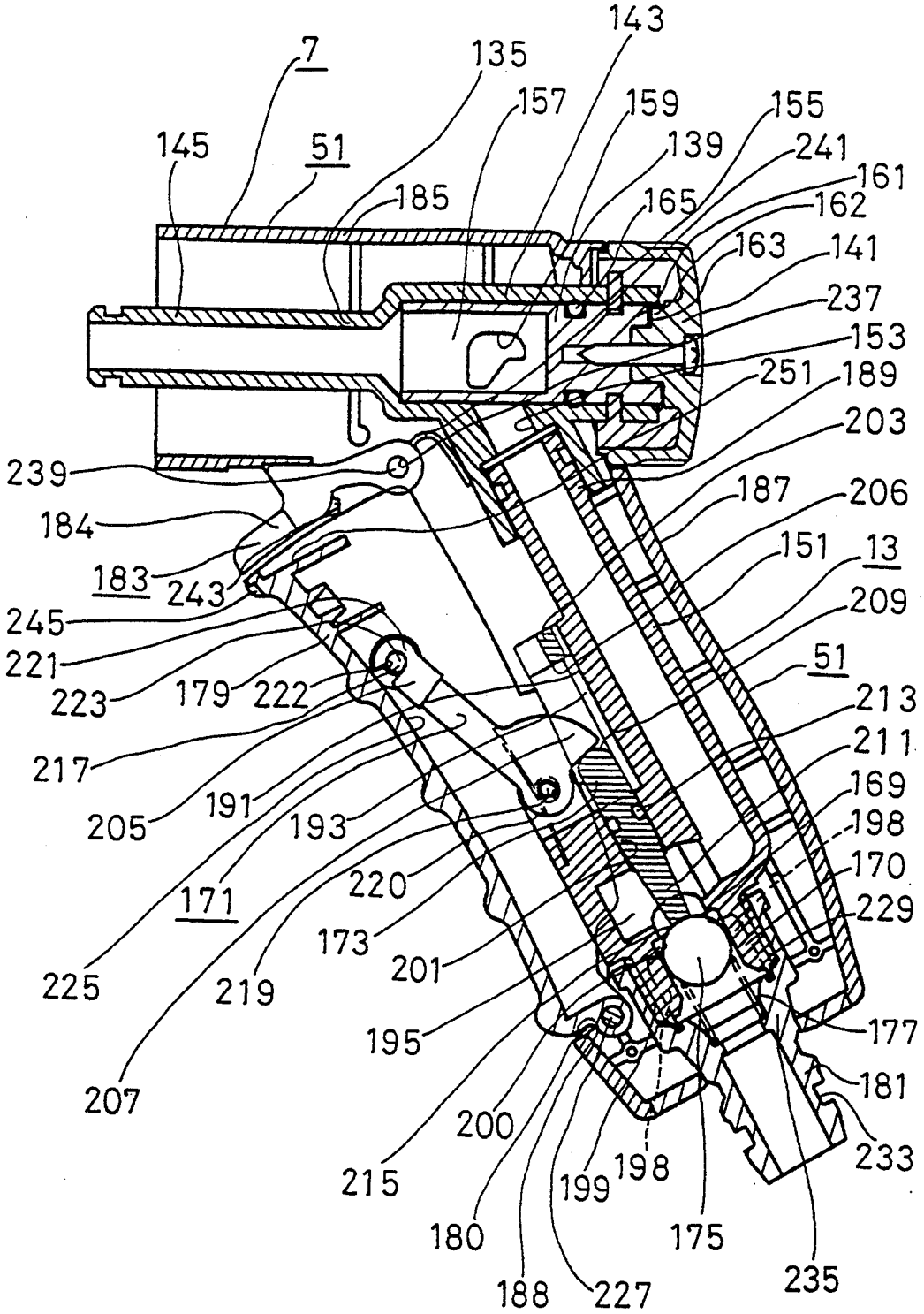
FIG. 4 is a cross-sectional view of the shower head taken along line 4—4 in FIG. 3, excluding a nozzle portion and a nozzle selecting portion.

As shown in FIGS. 3 and 4, the tube cock 139 is a cylindrical member rotatably secured in a watertight manner by an E-shaped retaining ring 155 in the large cylindrical part 143 of the main tube 135. The axial movement of the tube cock 139 is prevented by the ring 155. A profiled opening 159 is provided in a side face 157 of the tube cock 139 and corresponds to the water inlet 153 of the main tube 135. The profiled opening 159 is narrowed in its area from one end to the other end. An indentation 163 is formed in the right end of the tube cock 139 as viewed in the figure, i.e. a cock side 161 for engaging with a projection 162 of the handle cock 141 as described hereinafter. Thus, the tube cock 139 is rotated together with the handle cock 141. Specifically, by rotating the profiled opening 159 in the tube cock 139 using the handle cock 141, the opening ratio between the profiled opening 159 and the water inlet 153 is adjusted, thereby regulating the amount of water supplied to the main tube 135. An O ring 165 is provided between the main tube 135 and the tube cock 139 for preventing water from leaking toward the cock side 161.

The handle cock 141 is the cap-shaped member having a water-amount mark indicating the water regulating amount on an outer face 167 thereof.

As shown in FIG. 4, the grip 13 is composed of the grip housing 51, the valve tube 151 including a valve seat 169, a cam mechanism 171, a valve shaft 173, a valve ball 175, a valve spring 177, a valve operating handle 179, a connector 181, and a handle latch 183.

The grip housing 51 is composed of a cylindrical horizontal part 185 and a vertical part 187 for connecting the horizontal tubular part 7 to the grip 13. The horizontal part 185 is secured by the T-shaped ring 53, such that the spray housing 5 is rotatable relative to the part 185. The vertical part 187 extends downward from and forms an obtuse angle with the horizontal part 185. The nozzle selecting portion 11 and the water control 15 are disposed in the horizontal part 185, and the other components of the grip 13 are disposed in the vertical part 187. A reception 180 is formed in the left-side face as viewed in FIG. 4 of the vertical part 187 for receiving the valve operating handle 179 as described later. A protrusion 239 is formed above the reception 180 for rotatably engaging in a through hole 237 in the handle latch 183 as described later.

The valve tube 151 is the substantially L-shaped cylindrical waterway composed of an upper part 189. The upper part 189 is connected in a watertight manner to the water inlet 153 of the main tube 135. A rail 193 is provided on a forward surface 191 of the valve tube 151 for guiding the valve shaft 173 as described later. A lower part 195 of the valve tube 151 is bent perpendicularly from the upper part 189 and has an occluded point. The valve seat 169 is connected to a cylindrical member 170 in the middle of the bottom of the lower part 195 of the valve tube 151. The cylindrical member 170 has an inner diameter larger than the outer diameter of the valve ball 175. The waterway inside the valve tube 151 communicates with the waterway outside the valve tube 151 via the cylindrical member 170. When the valve ball 175 is urged upward, the valve seat 169 engages the valve ball 175 in a watertight manner, because a waterproof packing 200 is provided on the top of the valve seat 169. The packing 200 also serves as a shock absorber for the valve ball 175. When the valve ball 175 is forced downward against the urging of the valve spring 177 as described later, the valve seat 169 is opened. Thus, the cylindrical member 170 communicates with the inside of the valve tube 151. A projecting support 198 is formed on the inner wall of the cylindrical member 170 for axially guiding the valve ball 175. Also, a threaded portion 199 is formed on the outer periphery of the cylindrical member 170 for mating with the connector 181 as described later. Further, a through hole 201 for passing through the valve shaft 173 is extended upward from the top of the lower part 195 of the valve tube 151 in parallel with the upper part 189. As described later, the valve shaft 173 is axially slidably held in the through hole 201.

The valve shaft 173 is the rod-like member disposed substantially parallel with the upper part 189 of the valve tube 151. The valve shaft 173 has a substantially dome-shaped upper end 203. As shown in FIG. 4, the rail 193 provided on the valve tube 151 is received in the corresponding open side of the upper end 203. The valve shaft 173 is guided by the rail 193. An opening 206 is vertically provided and is horizontally open in the valve shaft 173 for receiving a circular arc portion 207 of a valve lever 205 as described hereinafter. The upper end 203 projects into the opening 206 into contact with the circular arc portion 207 of the valve lever 205. The valve shaft 173 has a lower part 211 conically tapered downward and is inserted into the through hole 201. The middle of the valve shaft 173 is provided with an O ring 213, such that the valve shaft 173 is engaged in the through hole 201 in a watertight manner. Further, the valve shaft 173 has a lower end 215 extending from the lower part 195 of the valve tube 151, passing through the valve seat 169 and contacting the valve ball 175.

The cam mechanism 171 includes the valve lever 205, a link roller 217 and a link shaft 219.

The valve lever 205 has a link roller retainer 221 at the upper end and the circular arc portion 207 at the lower end. The valve lever 205 is rotatably secured by the link shaft 219 on the top of the lower part 195 of the valve tube 151 adjacent to the valve shaft 173. The link roller retainer 221 is a U-shaped member opening upward. The link roller 217 is rotatably held in an indentation 222 formed in the link roller retainer 221. The circular arc portion 207 is inserted into the vertically provided opening 206 of the valve shaft 173. When the valve lever 205 is rotated clockwise, i.e. in the direction shown by an arrow Y1 in FIG. 9, the valve shaft 173 is moved downwardly, i.e. in the direction shown by an arrow Y2 in FIG. 9. The valve ball 175 is thereby moved downward against the force of the valve spring 177. The link roller 217 is a disc-shaped member, and a shaft 223 extends through the center of the link roller 217. The shaft 223 is rotatably held in the indentation 222 of the link roller retainer 221, and the link roller 217 is thus held in the link roller retainer 221. When the link roller 217 is pushed by the valve operating handle 179 as described hereinafter, the link roller 217 rotates smoothly along an inner wall 225 of the valve operating handle 179. As the link roller 217 can be smoothly moved along the inner wall 225, the position of the valve lever 205 can be changed easily and smoothly by the valve operating handle 179.

Figure 9:
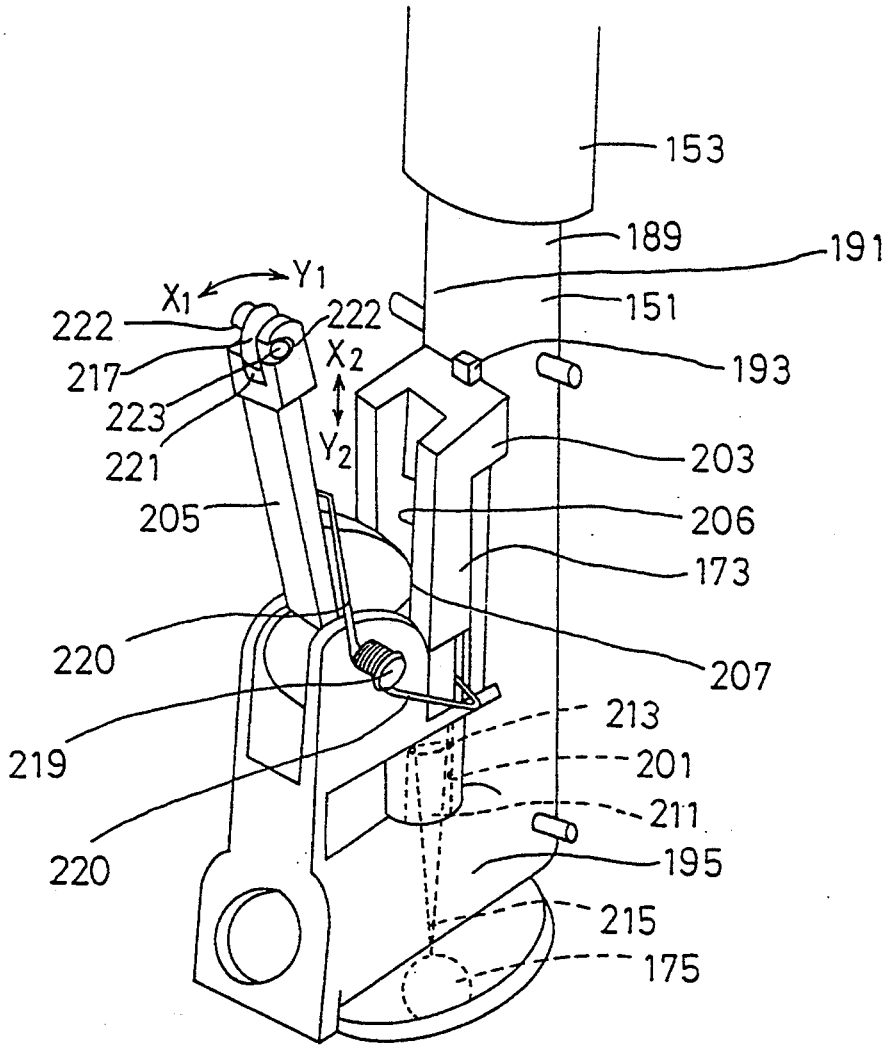
FIG. 9 is a perspective view of the combination of a valve shaft, a cam mechanism and a valve tube.

The link shaft 219 is provided with a return spring 220, such that the valve lever 205 is always pressed against the inner wall 225 of the valve operating handle 179, i.e. in the direction shown by an arrow X1 in FIG. 9. Therefore, as shown in FIG. 4, the valve operating handle 179 is always urged counterclockwise. Such urging prevents the valve lever 205 from rattling in the valve operating handle 179 and the grip housing 51.

The valve ball 175 is urged toward and into contact with the valve seat 169, by the valve spring 177 provided between the valve ball 175 and the connector 181, thereby retaining the valve ball 175 seated in a watertight manner.

The valve operating handle 179 is inserted in a recess 188 in the grip housing 51 and is rotatably supported by a pin 227. An indentation 245 is formed in the top of the valve operating handle 179 for engaging with the handle latch 183.

The connector 181 is a cylindrical member for connecting an external water supply to the cylindrical member 170. As already mentioned, the inner wall of the top of the connector 181 is provided with a threaded portion 229, such that the threaded portion 199 provided on the outer periphery of the cylindrical member 170 is engaged with the threaded portion 229. A groove 233 for receiving an O ring is formed in the outer periphery of the connecting part of the connector 181, thereby assuring the watertight communication with the external supply. A projection 235 is formed on the inner wall of the connector 181 for supporting the lower end of the valve spring 177.

Figure 12:
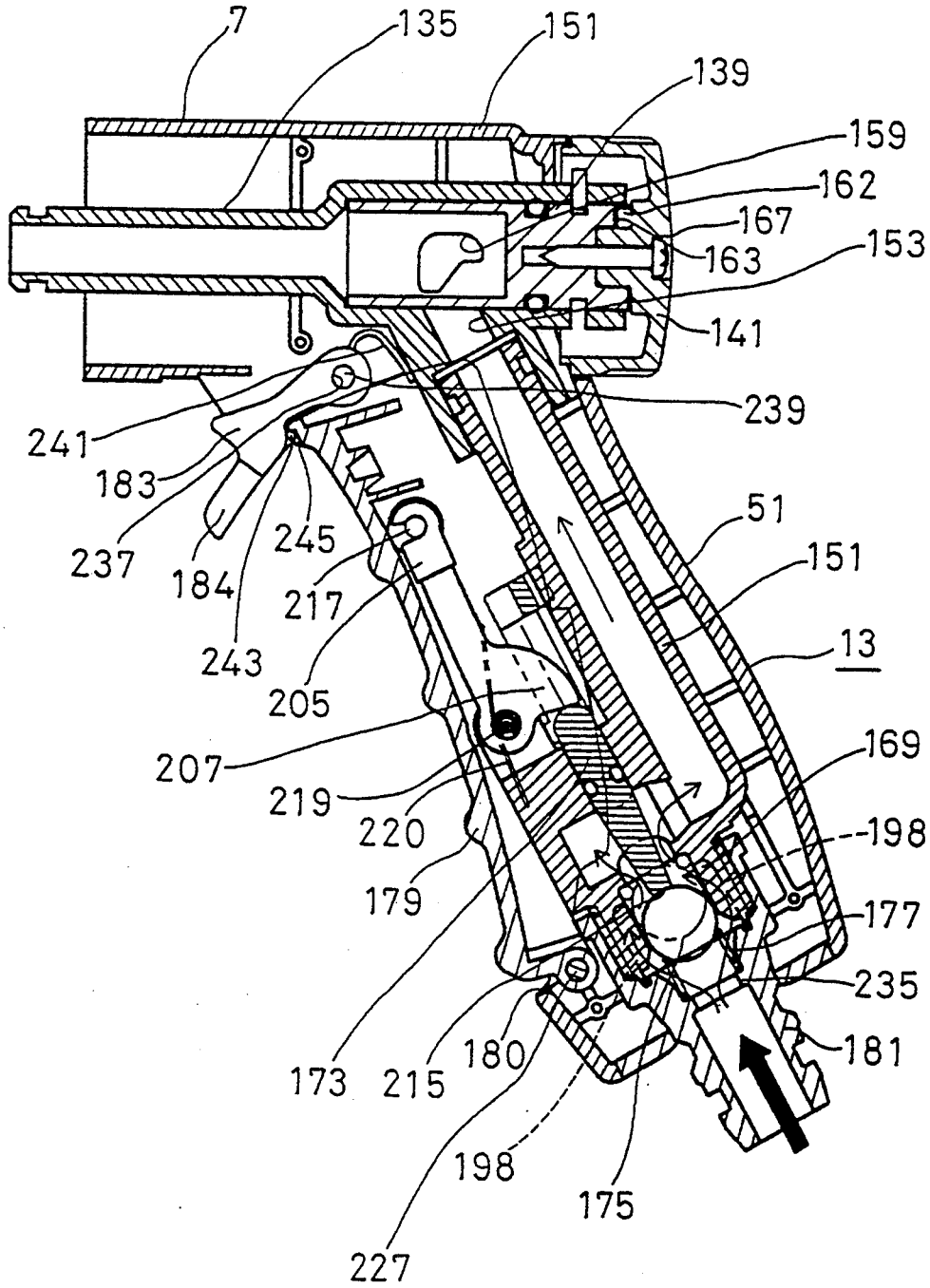
FIG. 12 is a cross-sectional view taken along the line 4—4 in FIG. 3, showing a handle grip in its gripped mode.

The handle latch 183 is a plate-like member having a lug 184, a bent leaf spring 241 and a projection 243 for stopping the valve operating handle 179. A through hole 237 is formed in the handle latch 183 to engage the protrusion 239 of the grip housing 51. The handle latch 183 is rotatably supported on the protrusion 239. Because the bent leaf spring 241 pushes on the main tube 135, the handle latch 183 is always urged clockwise. The projection 243 is formed on the underside of the handle latch 183. When the valve operating handle 179 is gripped toward the inside of the grip housing 51, as shown in FIG. 12, the projection 243 of the handle latch 183 engages in the indentation 245 of the valve operating handle 179, thereby securing the valve operating handle 179 in a depressed position.

The operation of the shower head 1 of the embodiment is now explained with reference to FIGS. 12 through 17.

First, the external water supply is connected to the connector 181 and water is supplied to the cylindrical member 170. At this stage the valve operating handle 179 is not yet depressed. Therefore, the valve seat 169 is closed in a watertight manner by the valve ball 175, and no water enters the shower head 1.

The valve operating handle 179 is now depressed (see FIG. 12) to push the valve lever 205 via the link roller 217 in the direction shown by the arrow Y1 in FIG. 9, so that the circular arc portion 207 pushes the valve shaft 173 downward. This movement in the direction shown by the arrow Y2 in FIG. 9 pushes the valve ball 175 against the force of the valve spring 177, thereby moving the ball 175 away from the seat 169 to allow water to flow thereby, as shown by the arrows in FIG. 12, into the valve tube 151. The projection 243 of the handle latch 183 is brought into engagement with the indentation 245 of the valve operating handle 179, thereby latching the valve operating handle 179 in its depressed position. No hydraulic pressure is applied to the side face of the valve shaft 173. Therefore, no water flow deviates or vibrates the valve shaft 173, and the valve ball 175 is retained at the desired position and water flows into the valve tube 151 with no turbulence. Furthermore, since there is no vibration among the components, neither wear nor damage results on the valve shaft 173, the valve ball 175 and the other associated components.

Subsequently, the amount of water is adjusted using the handle cock 141. By rotating the handle cock 141 and turning the water amount mark on the outer face 167 of the handle cock 141 to the desired position, the amount of water is determined. Specifically, at the beginning, as shown in FIG. 12, the profiled opening 159 does not overlap the water inlet 153 and no water is supplied into the main tube 135. Subsequently, by rotating the profiled opening 159 in the tube cock 139 using the handle cock 141, the opening ratio between the water inlet 153 and the profiled opening 159 is varied, and the amount of water to be discharged into the main tube 135 is regulated. The desired amount of water is supplied through the main tube 135 to the selector 43.

Figure 13:
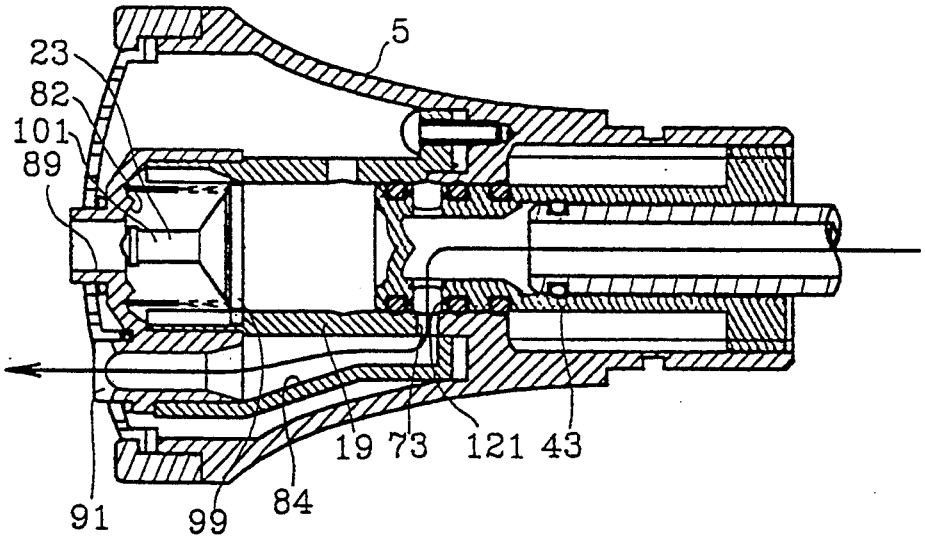
FIG. 13 is a variation of a partial cross-sectional view taken along line 3—3 in FIG. 2, showing the fan-shaped spray mode of the shower head.

By rotating the spray housing 5 to move one of the selection marks 3 printed on the outer periphery 61 to the set mark 63 of the T-shaped ring 53, the desired spray mode is selected. As shown in FIGS. 1, 3 and 13, when a fan-shaped spray mark 3*a* is turned to the set mark 63, the water outlet 121 of the selector 43 communicates with the first supply opening 73 of the distributor 19. As shown in FIG. 13, water is discharged from the selector 43 through the water outlet 121, the first supply opening 73 and the second chamber 84 to the associated rhomboid nozzle 91. The straight spray nozzle 89 is closed by the circular member 99 of the needle valve 23 to exclude dust or other foreign particles.

Figure 14:
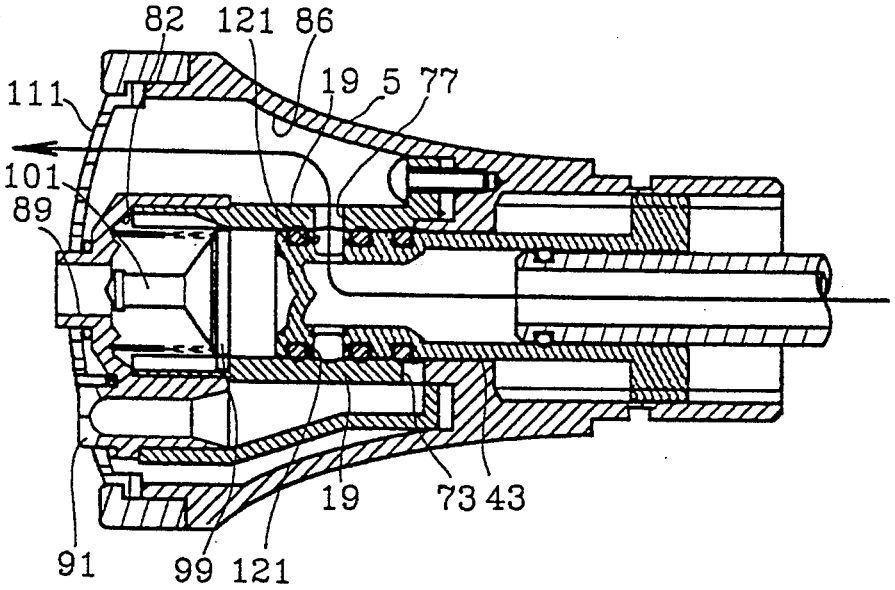
FIG. 14 is a variation of a partial cross-sectional view taken along line 3—3 in FIG. 2, showing the shower spray mode.

When the spray housing 5 is further rotated and a spray mark 3*b* is turned to the set mark 63, as shown in FIG. 14, the selector 43 is moved toward the spray side further from the position thereof shown in FIG. 13. The aforementioned communication between the water outlet 121 and the first supply opening 73 is discontinued. The water outlet 121 of the selector 43 now communicates with the second supply opening 77 of the distributor 19. As shown by an arrow in FIG. 14, water is discharged from the selector 43 through the water outlet 121, the second supply opening 77 and the third chamber 86 to the associated perforations 111.

Figure 15:
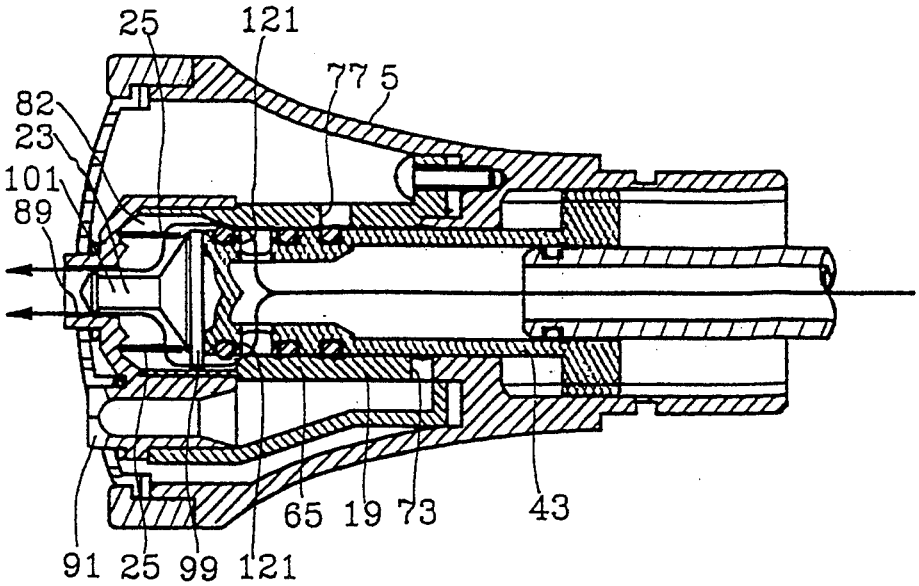
FIG. 15 is a variation of a partial cross-sectional view taken along line 3—3 in FIG. 2, showing the funnel-shaped spray mode.

When the spray housing 5 is further rotated and the funnel-shaped spray mark 3*c* is turned to the set mark 63, as shown in FIG. 15, the selector 43 is moved forward further from the position thereof shown in FIG. 14. The aforementioned communication between the water outlet 121 and the second supply opening 77 is discontinued. The selector 43 pushes forward the needle valve 23. The water outlet 121 of the selector 43 opens in the first chamber 82. Water is discharged from the selector 43 through the water outlet 121 and the first chamber 82 to the straight spray nozzle 89. Water gains the rotary force directed along the spiral direction of the coil spring 25, and is discharged straight along the axis of the needle valve 23. In such a condition, the opening ratio of the water outlet 121 in the first chamber 82 is so small that the amount of water is small and water is sprayed in a funnel shape. In this operational mode the straight spray nozzle 89 communicates with the inside of the distributor 19. However, because of the outward flow of water dust or foreign particles are excluded.

Figure 16:
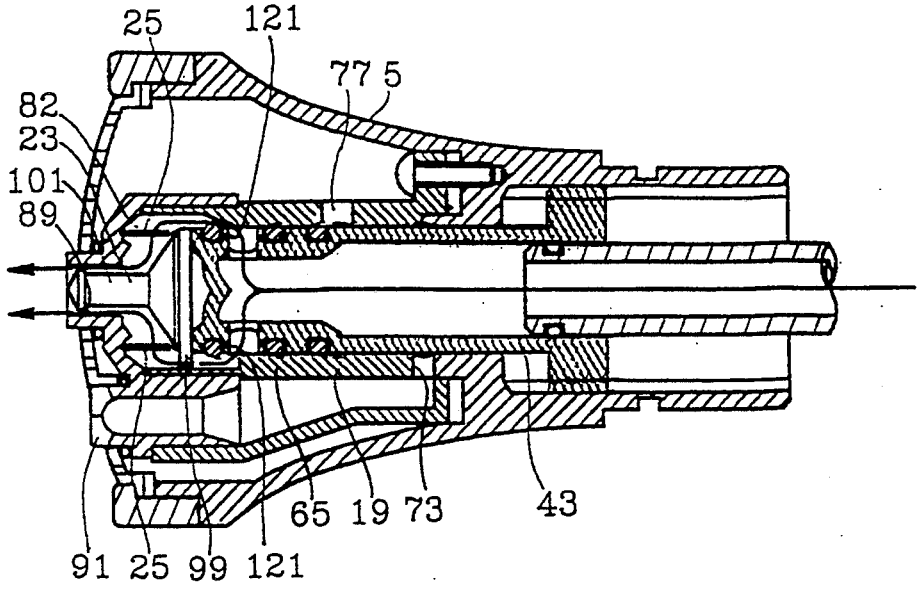
FIG. 16 is a variation of a partial cross-sectional view taken along line 3—3 in FIG. 2, showing the straight spray mode.

When the spray housing 5 is further rotated and a straight spray mark 3*d* is turned to the set mark 63, as shown in FIG. 16, the selector 43 is moved forward further from the position thereof shown in FIG. 15. The selector 43 moves the needle valve 23 further forward. As aforementioned, water is discharged from the selector 43 through the water outlet 121 and the first chamber 82 to the straight spray nozzle 89. However, the water outlet 121 of the selector 43 opens sufficiently widely in the first chamber 82, the sufficient amount of water is discharged axially straight forwards.

Figure 17:
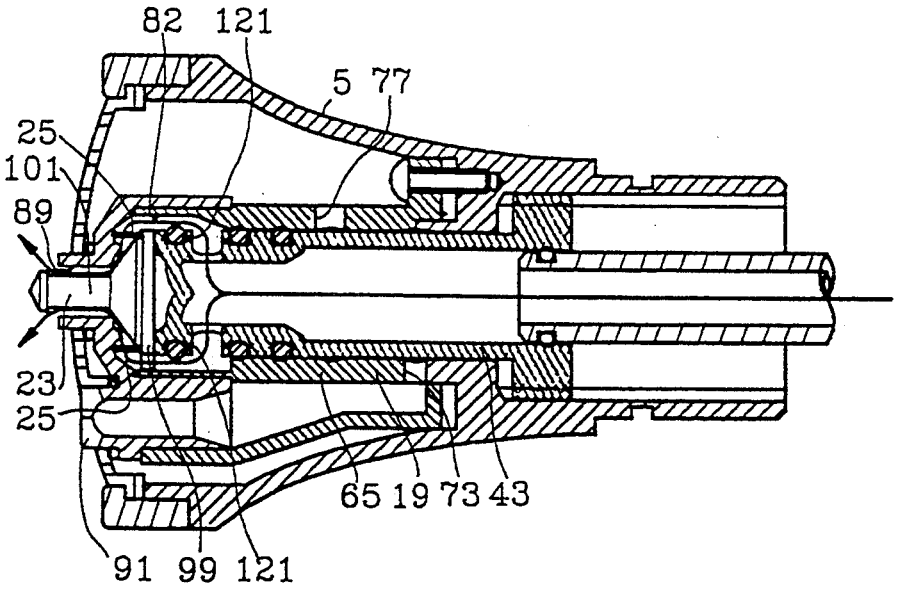
FIG. 17 is a variation of a partial cross-sectional view taken along line 3—3 in FIG. 2, showing the fine spray mode.
Figure 18:
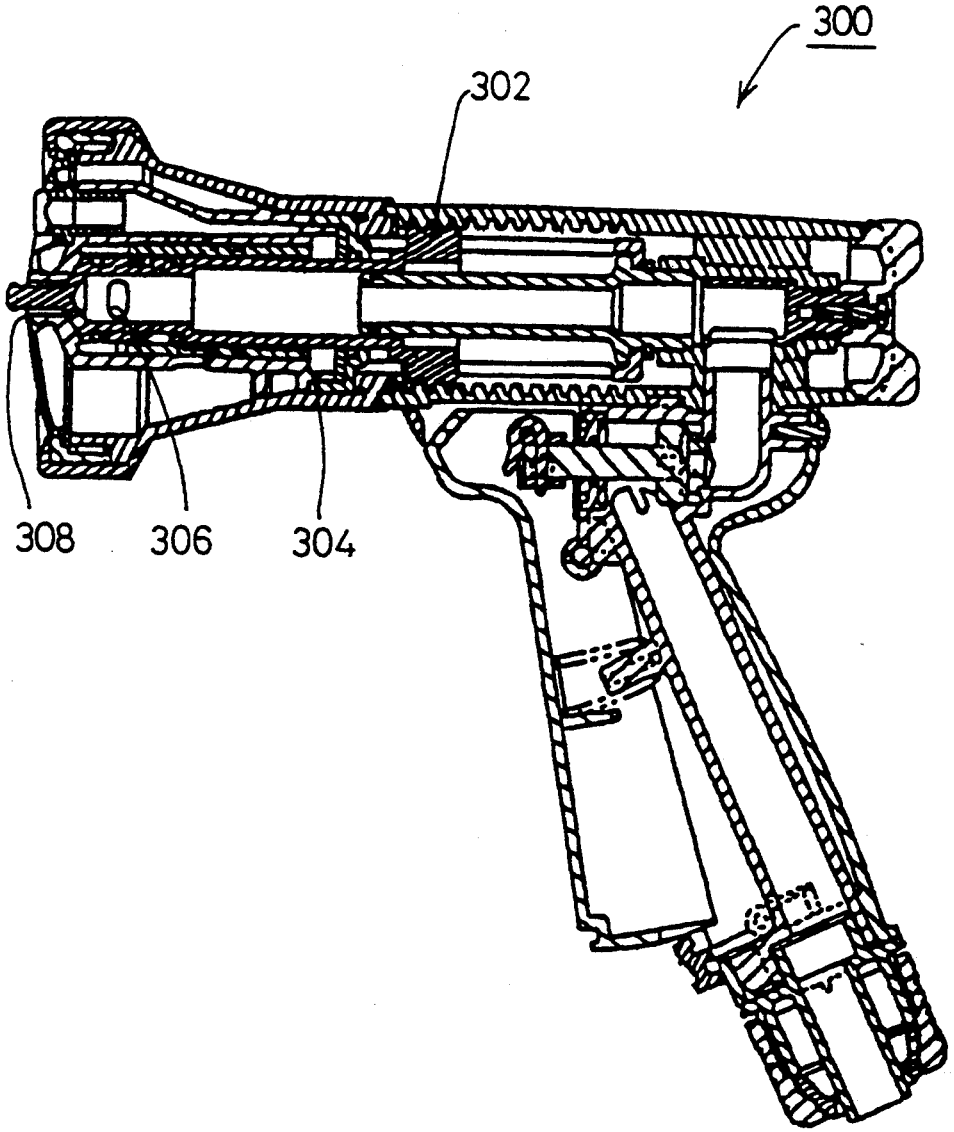
FIG. 18 is a cross-sectional view of a prior art shower head.

When the spray housing 5 is further rotated, and a fine spray mark 3*e* is turned to the set mark 63, as shown in FIG. 17, the selector 43 is moved forward further from the position thereof shown in FIG. 16. The selector 43 moves the needle valve 23 further forward. As aforementioned, water is discharged from the selector 43 through the water outlet 121 and the first chamber 82 to the straight spray nozzle 89. when the fine spray mark 3*e* is selected, however, the needle 101 of the needle valve 23 passes through the straight spray nozzle 89. The gap between the needle 101 and the straight spray nozzle 89 is so small that water flows along the needle 101 and collides at the umbrella-shaped point 105 of the needle valve 23. Water is thus finely sprayed in the form of an umbrella-shaped film.

To finish operating the shower head 1, the flow of water is stopped. Specifically, the valve operating handle 179 is gripped again. Since clearance is given between the handle-stopping projection 243 of handle latch 183 and the indentation 245 of the valve operating handle 179, the handle latch 183 is urged clockwise by the bent leaf spring 241. When the valve operating handle 179 is disengaged from the projection 243, the valve operating handle 179 is released. The valve shaft 173 then applies no pressure to the valve ball 175, and the valve ball 175 is urged upward by the valve spring 177. The valve seat 169 is thereby closed in a watertight manner. At the same time, the valve spring 177 pushes the valve shaft 173 via the valve ball 175 upward, i.e. in the direction shown by an arrow X2 in FIG. 9, and the valve lever 205 is urged counterclockwise, i.e. in the direction shown by the arrow X1 in FIG. 9. The return spring 220 urges the valve lever 205 counterclockwise. The valve lever 205 pushes and rotates the valve operating handle 179 counterclockwise. The valve operating handle 179 returns to the position thereof shown in FIG. 4. To further urge the valve operating handle 179 counterclockwise, as shown in FIG. 4, a spring bearing 251 can be provided between the valve operating handle 179 and the grip housing 51.

The amount and spray mode of water are selected preferably before water is supplied, so that the desired spray mode can be obtained at the same time when water is supplied. Fine adjustment can be done later to obtain the desired spray mode exactly.

In the embodiment, except when the selector 43 is detached from the needle valve 23 to spray water from the straight spray nozzle 89, the distributor 19 is closed by the circular member 99 of the needle valve 23 and can thus be kept from dust or other foreign particles. When water is sprayed from the straight spray nozzle 89, hydraulic pressure keeps the straight spray nozzle 89 from dust or other foreign particles. Consequently, no dust is caught between the distributor 19 and the side face of the sliding selector 43. The selector 43 is never scratched or harmed by dust or other foreign particles. The open diameter of the rhomboid nozzles 91 and the perforations 111 is relatively so small that no dust enters the selector 43 or causes the aforementioned problems.

The invention has been described above with reference to a preferred embodiment shown in the drawings. Modifications and alterations may become apparent to one skilled in the art upon reading and understanding the specification. Despite the use of the embodiment for illustration purposes, it is intended to include all such modifications and alterations within the scope and the spirit of the appended claims.

What is claimed is:

1. A shower head comprising:

a housing defining an axis;

a shower face disposed in said housing and being provided with a first nozzle for spraying a straight jet of water and a second nozzle for spraying water in a mode different from that sprayed by of said first nozzle;

a first chamber defined by said housing and connected to said first nozzle;

a second chamber defined by said housing, separated from said first chamber and connected to said second nozzle;

a water supply tube in said housing and fast therewith, for supplying water to said first nozzle and said second nozzle, having a first opening connected to said first chamber, and a second opening connected to said second chamber;

a spring biased valve supported in said first chamber and biased to close said first opening;

a selector valve slidably mounted in said water supply tube and moveable between first and second positions to connect a supply of water to said first opening or to said second opening; and a means for slidably moving said selector valve to and from said first position in which water is supplied through said second opening and a second position in which water is supplied through said first opening and the spring biased valve is opened against said spring bias; whereby when said selector is in said first position, said shower head issues water from said second nozzle, when said selector is in said second position said showerhead issues water from said first nozzle, and when in the second position the selector valve physically contacts the spring biased valve in order to open the spring biased valve.

2. The shower head of claim 1 wherein said spring biased valve includes a needle valve able to move through and project from said first nozzle as said spring biased valve is moved thereby to adjust and control issuance of water from the first nozzle.

3. The shower head of claim 1 wherein the water supply tube is cylindrical, the first opening opens longitudinally of the tube to allow the selector valve to come into contact with the spring biased valve to open this valve, the second opening extends radially through the tube and the selector valve is a spool valve.

4. The shower head of claim 3 wherein the shower face defines a plurality of spray perforations to provide a further, fine spray, mode of spraying water.

5. The shower head of claim 4 wherein a third chamber defined by said housing, separated from said first and second chambers is connected to said spray perforations and said water supply tube has a third, radially disposed, opening for supplying water to said spray perforations by way of said third chamber.

6. The shower head of claim 5 wherein said selector valve is slidably mounted to selectably also connect a supply of water to said third opening and said slidably moving means is also for moving said selector to and from a third position in which water is supplied to said third opening.

7. The shower head of claim 1 wherein said mode is selected by rotation of said housing about said axis relative, to a stationary part of said shower head and said slidably moving means comprises a splined interconnection between said housing and said selector valve to maintain alignment therebetween about said axis and a threaded interconnection between said slidable moving means and said stationary part to slidably move said selector valve to and from said first and second positions upon said rotation of said housing.

8. The shower head of claim 1 wherein the selector valve only opens the spring biased valve while in said second position.

* * * * *